US007726359B2

(12) United States Patent
Hartono et al.

(10) Patent No.: US 7,726,359 B2
(45) **Date of Patent: *Jun. 1, 2010**

(54) METHOD FOR TRANSFERRING A CRYOGENIC FLUID

(75) Inventors: John S. Hartono, Oakland, CA (US); Kenneth W. Sheets, Jr., San Ramon, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 638 days.

This patent is subject to a terminal disclaimer.

(21) Appl. No.: 11/613,722

(22) Filed: Dec. 20, 2006

(65) Prior Publication Data

US 2008/0148741 A1 Jun. 26, 2008

(51) Int. Cl.
*B65B 1/20* (2006.01)

(52) U.S. Cl. ..... 141/82; 141/231; 141/285; 141/387; 62/50.1

(58) Field of Classification Search ..... 141/1, 141/82, 231, 285, 301, 302, 367, 382, 387–389; 441/4, 5; 62/50.1, 50.7
See application file for complete search history.

(56) References Cited

U.S. PATENT DOCUMENTS 3,969,781 A * 7/1976 Reid, Jr. ..... 441/5
4,315,408 A 2/1982 Karl
4,445,543 A 5/1984 Mead
6,012,292 A 1/2000 Gulati et al.
6,244,053 B1 6/2001 Gulati et al.
2003/0089434 A1* 5/2003 Flynn et al. ..... 149/1
2007/0155260 A1* 7/2007 Poldervaart et al. ..... 441/5
2008/0148741 A1* 6/2008 Hartono et al. ..... 62/50.1

OTHER PUBLICATIONS

Case Study: Stress and thermal analysis of an LNG marine loading arm, http:/www.lusas.com/case/analyst/loadingarm.html, Dec. 13, 2006, pp. 1-3.
Chiksan Marine Loading Arms, http://www.fmctechnologies.com/LoadingSystems/Solutions/TopsidesPackages/ChicksanMarineLoadingArms.aspx, Dec. 13, 2006, pp. 1-2.

* cited by examiner

*Primary Examiner*—Gregory L Huson
*Assistant Examiner*—Jason K Niesz
(74) *Attorney, Agent, or Firm*—A. Stephen Zavell

(57) ABSTRACT

A method for transferring a cryogenic fluid from a floating vessel. The cryogenic fluids to be transferred can include liquefied hydrocarbon gases such as LNG. The method includes the steps of pumping a reduced flow of a cryogenic fluid into a first end and/or a second end of a conduit to begin pre-cooling the conduit. Pre-cooling also includes pumping a reduced flow of the cryogenic fluid into the conduit at a point intermediate the first end and the second end so that different sections of the conduit are cooled simultaneously. When the conduit has cooled to a temperature suitable for transferring the cryogenic fluid, an increased flow of the cryogenic fluid is pumped into the first end of the conduit to transfer the cryogenic fluid from the floating vessel. The cryogenic fluid can then be directed from the second end of the conduit to a storage tank on shore or onboard a second floating vessel.

21 Claims, 5 Drawing Sheets

METHOD FOR TRANSFERRING A CRYOGENIC FLUID

FIELD OF THE INVENTION

The present invention relates to the transfer of cryogenic fluids, such as a liquefied natural gas, to or from a floating vessel prior to or after transport from a remote location. More specifically, the invention relates to loading arms and transfer flow lines that are used to transfer cryogenic fluids to or from a floating vessel and the chilling or pre-cooling of such loading arms and lines to suitably low temperatures in preparation for such transfers.

BACKGROUND OF THE INVENTION

Natural gas is often discovered and produced in locations that are remote from where the gas can be marketed and distributed to end users. When suitable pipelines are available, the natural gas can be transported to market in either a gaseous or liquid form, however, there are many instances in which such pipelines are not available or practical for connecting a particular natural gas supply with consumers. When natural gas supplies are located overseas or a substantial distance from a suitable distribution system, it may be necessary to transport the gas by vessel. Such vessels typically include specially designed carriers that transport natural gas as a liquid housed in large insulated containers or tanks.

When transported at or near atmospheric pressure liquefied natural gas (LNG) is held at temperatures slightly below about −160° C. This temperature represents the boiling-point temperature for methane at atmospheric pressure. However, since the composition of natural gas will typically contain variable amounts of heavier and higher boiling hydrocarbons such as ethane, propane, butane and the like, the liquefied gas will be characterized by a somewhat higher boiling temperature, usually ranging from about −151° C. to about −164° C. depending upon composition. At or near a destination, the LNG must be regasified and warmed before it can be introduced into a distribution pipeline. In addition, depending on the requirements of the pipeline and local natural gas specifications, the LNG may be pressurized, depressurized, blended, odorized or subjected to other processing before it can be introduced into a pipeline or similar distribution system.

In both the loading and off-loading of LNG or other cryogenic fluids from a vessel, loading arm(s) and flow line(s) are used to transfer the cryogenic fluid. Due to the relatively low temperature of these fluids, the loading arms and flow lines must be pre-cooled or chilled to cryogenic temperatures before transfer operations can begin. Conventional cool-down procedures can require two to five hours depending on the materials and features of the arm and flow lines, the port requirements, and the recommendations of the loading arm/flow line manufacturer. Modifications that would enable such cool-down procedures to be completed more quickly while complying with port requirements and manufacturer recommendations would be advantageous and would enable additional vessels to be loaded and unloaded at a given terminal each year.

SUMMARY OF THE INVENTION

The present invention provides a method for transferring a cryogenic fluid. The method includes the steps of pumping a reduced flow of a cryogenic fluid into a first end and/or a second end of a conduit pumping a reduced flow of the cryogenic fluid into the conduit at a point intermediate the first end and the second end; and pumping an increased flow of the cryogenic fluid into the first end of the conduit from a storage tank onboard a floating vessel when the conduit has cooled to a temperature suitable for transferring the cryogenic fluid.

The reduced flow of cryogenic fluid can be pumped into the conduit at an intermediate point between the first end and the second end by directing the reduced flow of cryogenic fluid through a first cool down line that is in fluid communication with the conduit at the intermediate point. Optionally, a reduced flow of the cryogenic fluid can be pumped into the conduit at a second intermediate point between the first end and the second end through either the first cool down line or a second cool down line in fluid communication with the conduit at the second intermediate point.

The reduced flow of cryogenic fluid pumped to the first end and/or second end of the conduit can be derived from a storage tank or liquefaction unit located on-board a floating vessel and/or from a storage tank or liquefaction unit located on shore. Similarly, the reduced flow of the cryogenic fluid pumped into the conduit at a point intermediate the first end and the second end is derived from a storage tank or liquefaction unit located on-board a floating vessel and/or from a storage tank or liquefaction unit located on shore.

Where a portion of the reduced flow of cryogenic fluid that is pumped into the conduit forms a boil off gas, the method can further include the step of removing the boil off gas from the conduit or from a storage tank receiving the reduced flow of cryogenic fluid. Boil off gas removed from the conduit or the storage tank can optionally be directed to a liquefaction unit on-board a floating vessel or on shore.

The method can optionally include one or more of the steps of purging the conduit with an inert fluid before pumping a reduced flow of the cryogenic fluid into the conduit and of directing the increased flow of cryogenic fluid from the conduit to a cryogenic storage tank located on shore or a second floating vessel.

BRIEF DESCRIPTION OF THE DRAWINGS

The invention may be understood by reference to the following description taken in conjunction with the accompanying drawings.

Figure 1:
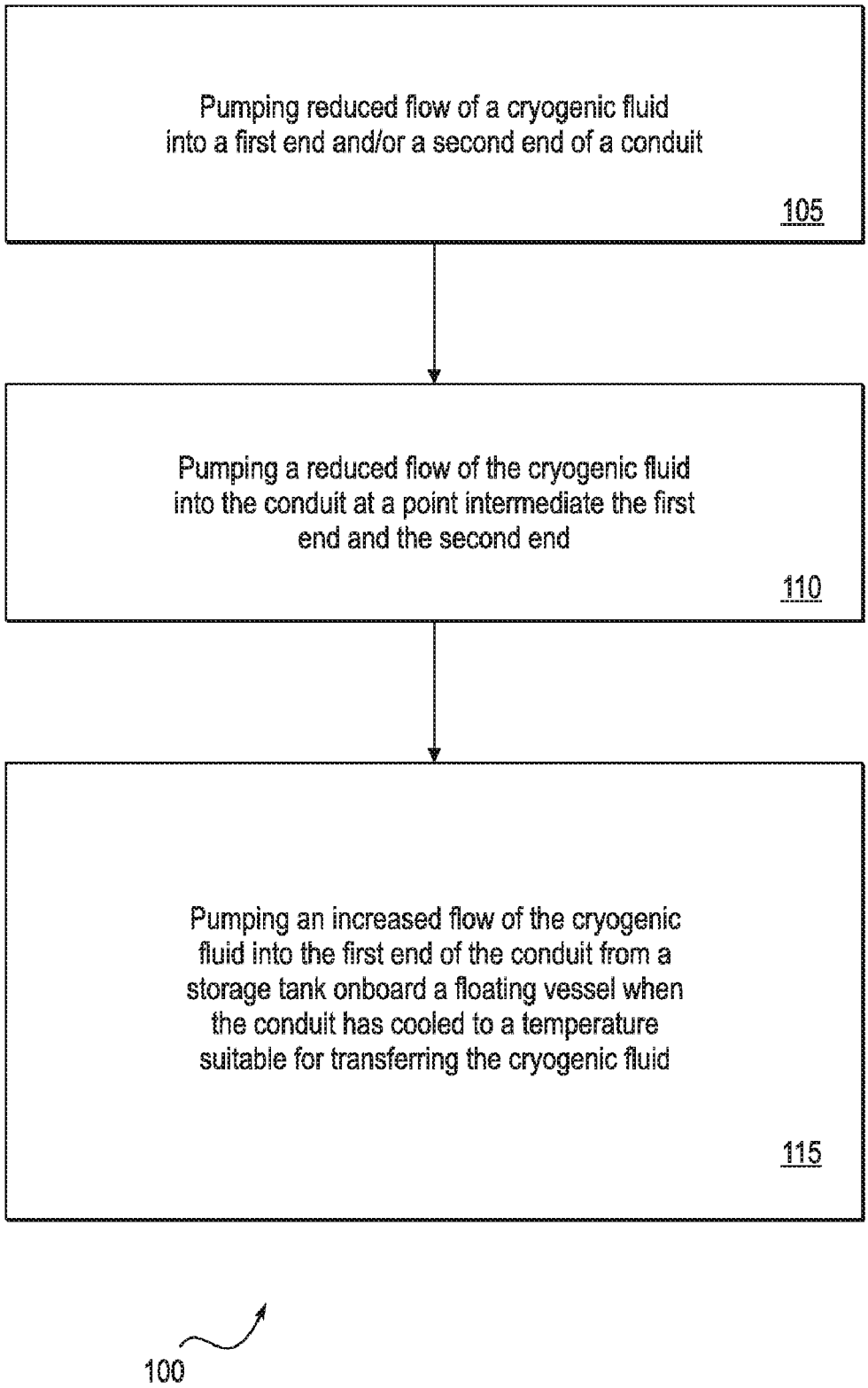
FIG. 1 is a representation of a method of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENTS

Illustrative embodiments of the invention are described below. In the interest of clarity, not all features of an actual embodiment are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover it will be appreciated that such a development effort might be complex and time-consuming, but would nevertheless be a routine undertaking for those of ordinary skill in the art having the benefit of this disclosure.

Although the methods of the present invention are frequently described herein in terms of the transfer of liquefied natural gas, the methods are intended to be used in association with the transport and transfer of other cryogenic fluids as well. As used herein, and unless expressly stated otherwise, "cryogenic fluid" is intended to include any cryogenic fluid that is chilled with or without compression to reduce its volume for storage or transport. Examples of cryogenic fluids include liquefied natural gas, liquefied petroleum gas, compressed natural gas, and the like. More specifically, the cryogenic fluids that can be transferred utilizing the methods of the present invention can comprise methane, ethane, propane, butane, ammonia or mixtures of the same.

The pressure of the cryogenic fluid can range from ambient to an elevated pressure. Maintaining the cryogenic fluid at elevated pressure may be desirable for certain applications and fluids, particularly since fluids at elevated pressures can frequently be held in a liquid phase at relatively higher temperatures. By way of example, some choose to maintain liquefied natural gas at elevated pressures in order to reduce the refrigeration load that is required to liquefy and hold the gas in the liquid state. As a result, the cryogenic fluids associated with the methods of the present invention may be held at an elevated pressure, and in particular, may be held at an elevated pressure in the range between about 15 psig and about 650 psig.

The cryogenic fluids suitable for use in the methods of the present invention are chilled in order to reduce their volume. In some embodiments, the cryogenic fluid is at a temperature of less than about −50° C. In other embodiments, the cryogenic fluid is at a temperature of less than about −100° C. In still other embodiments, the cryogenic fluid is at a temperature of less than about −150° C. The temperature of the cryogenic fluid will depend on the composition of the fluid and the desired state or phase of he fluid during storage and transport. By way of example, natural gas can be cooled with or without compression to form LNG. When the LNG is to be stored and transported at or near atmospheric pressure, the gas must be chilled to less that about −160° C. to condense the gas to liquid. The natural gas is liquefied in a plant that is typically located on-shore near the site where the natural gas is produced, but may also be located in another location or off-shore depending on the location of the producing gas field.

Following their liquefaction, cryogenic fluids are frequently held in cryogenic storage to await loading onto a vessel for transport to a remote market. Cryogenic storage is typically adjacent or near the liquefaction plant so as to reduce the amount of boil off gas that might otherwise develop as the fluid is transported from the liquefaction plant to storage. Similarly, it is desirable to locate the cryogenic storage adjacent or near a loading terminal so as to reduce the amount of boil off gas that might otherwise develop as the fluid is transported from storage to the vessel. After transport, the cryogenic fluid is typically off-loaded and directed to storage to await regasification and introduction into a gas distribution system. Whether cryogenic storage is to be used prior to or following transport, it is desirably located adjacent a waterway to enable direct access by floating vessels. In some cases flow lines may be provided to connect on-shore storage tanks with either a near-shore or off-shore terminal or buoy. Jetties are also commonly used for near-shore terminals where shore-side berthing at the storage site is unavailable.

Regardless of the precise location of the cryogenic storage relative to a liquefaction plant, a regasification plant or terminals, loading arms and flow lines will be required for loading and off-loading the cryogenic fluid from the floating vessel. Loading arms typically include a pedestal that is fixed to a jetty, dockside, or vessel deck, a system of articulating conduit sections that are joined together at knuckles or joints, and a counterbalance supporting structure. The pedestal is typically manufactured from carbon steel and provides structural support to the conduit and the counterbalance structure. The conduit sections are typically manufactured of high grade stainless steel. The size of these conduits can vary depending on the needs of the terminal, its location and the capacity of the vessels. Standard diameters range from 4 inches through 24 inches, with more typical sizes ranging between 16 inches and 20 inches. The knuckles or joints between sections of conduit are typically swivel joints that allow the conduit sections to articulate about the joint. The joints are required to carry heavy loads and have seals to prevent product leakage. Conventional LNG loading arms are commercially available from such companies as FMC Technologies, SVT Schwelm GmbH, Niigata Marine Loading Arms, Aker Kvaener Lading Arm Technologies and EMCO WHEATON GmbH.

Depending on the location and the configuration of the terminal, additional conduits or flow lines may be used to transfer the cryogenic fluid to the loading arm or directly to the vessel or storage tanks. Such conduits can also be made of high grade stainless steel, composites such as Invar that experience limited expansion and contraction in response to changes in temperature, as well as other specially designed tubing or hoses. Specially designed hoses and tubing, and systems utilizing such conduits for transferring LNG are described in greater detail in U.S. Pat. No. 4,315,408, issued Feb. 16, 408 to Karl, U.S. Pat. No. 4,445,543 issued May 1, 1984 to Mead, U.S. Pat. No. 6,012,292 issued Jan. 11, 2000 to Gulati, et al., and U.S. Pat. No. 6,244,053 issued Jun. 12, 2001 to Gulati, et al.

The low temperatures of cryogenic fluids require that these loading arms and flow lines be pre-cooled to cryogenic or near-cryogenic temperatures prior to transfer operations. Failure to pre-cool these conduits will produce thermal stress on the conduit and joints that can result in failure or shortened life. Moreover, a significant amount of cryogenic fluid may vaporize and form boil off gas as the fluid take sup heat form the relatively warmer conduit. Pre-cooling of the conduit prior to each transfer operation can require several hours depending on the length and configuration of the conduit, the local port requirements and recommendations of the manufacturer. The present invention is directed at reducing the time required to pre-cool a transfer or flow line to a cryogenic temperature or other temperature suitable for transferring the cryogenic fluid.

More specifically, the present invention provides a method for transferring a cryogenic fluid from a floating vessel. The method comprising the steps of pumping a reduced flow of a cryogenic fluid into a first end and/or a second end of a conduit; pumping a reduced flow of the cryogenic fluid into the conduit at a point intermediate the first end and the second end; and pumping an increased flow of the cryogenic fluid into the first end of the conduit from a storage tank onboard a floating vessel when the conduit has cooled to a temperature suitable for transferring the cryogenic fluid. By pumping a reduced flow of cryogenic fluid into both an end of the conduit and one or more points intermediate the ends of the conduit, multiple sections of the conduit can be cooled simultaneously.

In operation, a floating vessel having cryogenic storage tanks, sometimes described herein as an LNG carrier or ship, is first moored at an off-loading terminal. Where the ship is to engage in a ship to ship transfer of the LNG, the floating vessel will be moored to or near a second floating vessel. There are generally two or more, and typically four loading arms that would be used to transfer LNG to or from the vessel through the ship's on-board manifold. One of these loading arms is generally dedicated for transferring vapor in the form of boil off gas that can form in the transfer lines or within a vessel's storage tanks. The vapor can be led ashore or to another vessel having facilities to receive and handle the vapor. This vapor return path also allows the operators to control pressure within the shipboard tanks. In an alternative embodiment, the boil off gas might be re-condensed onboard the vessel and directed to the vessel's storage tanks. In still other embodiments, the boil off gas might be directed to an on-board power generation unit. In such alternate embodiments, a vapor return arm and conduit to a shore side facility could be eliminated.

Custody Transfer level readings are taken. After the conduit of the vapor return arms is secured to the LNG ship's manifold and either the off-loading terminal or the manifold of a second floating vessel, and the valve in the vapor return arm is opened to allow boil off gas on board the ship to be led ashore. After the other loading arm conduits are connected with the ship's manifold, operators can begin to prepare the conduits for transferring cryogenic fluid from the cryogenic storage tanks onboard the vessel.

"Conduit" is intended herein to refer to tubing, flow line or transfer line used to transfer cryogenic fluid. Such conduits may or may not be associated with a loading arm. A conduit for transferring the cryogenic fluid will have a first end and a second end. After connecting the first end of the conduit with the ship's manifold but before operators begin pre-cooling the conduit, they will typically test the conduit for leaks and oxygen levels, and ensure that emergency systems are functioning properly. Depending on the oxygen level detected, the conduit may be purged before pre-cooling is initiated. Prior to LNG transfer, the oxygen content within the conduit should be less than about 1% vol. When purging is desired, an inert gas such as nitrogen, argon, helium or the like, can be flowed through the conduit.

Pre-cooling of the conduit begins by pumping a reduced flow of the cryogenic fluid into the first and/or second end of the conduit. This reduced flow of cryogenic fluid can be derived from a storage tank or liquefaction unit located onboard a floating vessel and/or from a storage tank or liquefaction unit located on shore. When the cryogenic fluid is LNG, the LNG is pumped into the conduit at a temperature of less than about −160° C. As the reduced flow of LNG slowly fills the conduit from the first end, the section of the conduit in contact with the LNG is cooled to a temperature suitable for transferring LNG. The rate at which this reduced flow of LNG is pumped into the inlet of the conduit will be controlled so as to prevent thermal shock to the conduit and the storage tanks that will receive the transferred LNG. This cooling rate is generally prescribed by the arm and tank manufacturer but will also depend on the initial temperature and pressure conditions in the tanks as well. An acceptable chill rate for typical conduit and tank materials is less than 9° C. per hour.

The time required to adequately chill the conduit before the flow rate of the cryogenic fluid can be increased, will depend on the starting temperature of the conduit, its length and the configuration of its sections among other factors. By way of example, the conduit may have a vertical section or riser such that the reduced flow of LNG pumped into the end of the conduit must first fill and rise up through the vertical section before it can reach downstream sections of the conduit. Where the conduit includes articulating sections that are joined by swivel joint(s) or knuckles(s), an apex may be formed between the sections depending on the angle between the conduit sections. In conventional pre-cooling processes, such a vertical section must be completely filled with cryogenic fluid before the fluid can reach spill over and begin to cool downstream sections of the conduit.

To begin cooling downstream sections of the conduit more quickly, the methods of the present invention include the step of pumping a reduced flow of cryogenic fluid into the conduit at a point intermediate the first end and the second end of the conduit. This reduced flow of cryogenic fluid can also be derived from a storage tank or liquefaction unit located onboard a floating vessel and/or from a storage tank or liquefaction unit located on shore.

In one embodiment, this reduced flow of cryogenic fluid is pumped into the conduit at the intermediate point by directing the reduced flow of cryogenic fluid through a first cool down line that is in fluid communication with the conduit at the intermediate point. The first cool down line is generally of smaller diameter than that of the conduit, generally less than about 6 inches. In some embodiments, the diameter of the cool down line is less than about 4 inches and in others, it is less than about 2 inches. In some embodiments, the first cool down lines is external to the conduit and intersects with the conduit at the intermediate point between the first and second ends of the conduit. In other embodiments, the first cool down line is disposed within the conduit and is in fluid communication with the conduit through an opening in the first cool down line at the intermediate point.

The intermediate point between the ends of the conduit can be located at a joint or knuckle where articulating sections of the conduit are joined. In other embodiments, the intermediate point is located adjacent to such a joint so that as the reduced flow of cryogenic fluid enters the conduit, it flows through the downstream section of the conduit. In still other embodiments, the intermediate point is located at an apex in the conduit.

Depending on the length of the conduit and the configuration of its sections, a reduced flow of cryogenic fluid may be pumped into the conduit at a second intermediate point located between the ends of the conduit. The reduced flow of cryogenic fluid that is pumped to this second intermediate point may be directed through a common cool down line, such as the first cool down line described above, or through a dedicated second cool down line that is in fluid communication with the conduit at the second intermediate point. It is envisioned that the reduced flow of cryogenic fluid may be pumped into the conduit at three or more points intermediate the ends of the conduit depending on the length and configuration of the conduit.

A portion of the reduced flow of LNG pumped into the conduit can form boil off gas in the conduit and in storage tanks. In one embodiment, the boil off gas can be removed from the conduit or a storage tank receiving the LNG. The removed boil off gas can be directed to a liquefaction unit on-board a floating vessel or on shore where it will be re-condensed and directed to an on-board power generation unit or used in other on-board operations. Other options for handling boil off gas are noted above.

When the conduit has cooled to a temperature suitable for transferring the cryogenic fluid, an increased flow of the cryogenic fluid is pumped into the inlet to reach an optimum or maximum transfer rate. The rate of this increased flow of cryogenic fluid will depend on the capacity and conditions of the vessel's storage tanks, the vessel's manifold and the size of the conduit. An increased flow of cryogenic fluid through a 16" conduit can be pumped at a rate of 5000 $m^3$/hr, but again the capacity of a given vessel's manifold may further limit this flow rate. The cryogenic fluid can then be directed from the second end of the conduit to a cryogenic storage tank located on shore or on a second floating vessel.

Optionally, while the increased flow of cryogenic fluid is pumped into and through the conduit, the reduced flow of cryogenic fluid that is pumped into the conduit at the intermediate point can be interrupted.

DETAILED DESCRIPTION OF THE FIGURES

FIG. 1 is a flow chart representation of a method 100. As designated at reference number 105, a reduced flow of a cryogenic fluid is pumped into a first end and/or a second end of a conduit. Step 110 is directed to the pumping of a reduced flow of the cryogenic fluid into the conduit at a point intermediate the first end and the second end. When the conduit has cooled to a temperature suitable for transferring the cryogenic fluid, an increased flow of cryogenic fluid is pumped into the first end of the conduit from a storage tank onboard a floating vessel, as indicated at 115.

Figure 2:
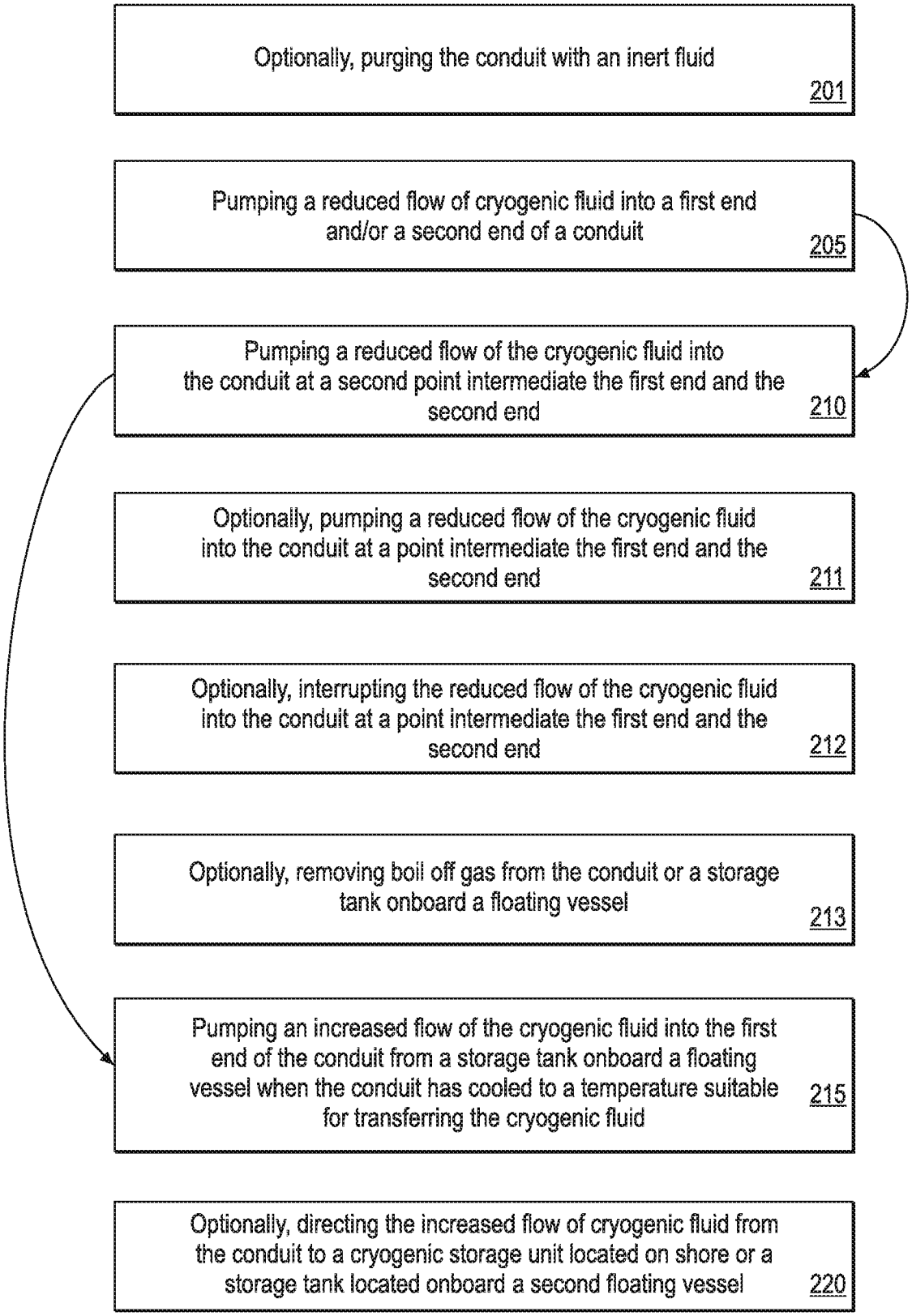
FIG. 2 is a representation of a method of the present invention.

Another method 200 is illustrated in FIG. 2, which can include the optional step 201 of purging the conduit with an inert fluid. Step 205 is directed to pumping a reduced flow of cryogenic fluid into a first end and/or a second end of a conduit. Step 210 provides that a reduced flow of the cryogenic fluid is pumped into the conduit at a point intermediate the first end and the second end. Optional step 211 provides that a reduced flow of the cryogenic fluid can be pumped into the conduit at a second point intermediate the first end and the second end. Optional step 212 provides for interrupting the reduced flow of LNG into the intermediate port when the conduit has cooled to a temperature suitable for transferring. Optional step 213 provides for removing boil off gas that may form during the pre-cooling of the conduit. Step 215 provides that an increased flow of the cryogenic fluid is pumped into the first end of the conduit from a storage tank onboard a floating vessel when the conduit had cooled to a temperature suitable for transferring the cryogenic fluid. Optionally, the increased flow of cryogenic fluid is directed from the conduit to a cryogenic storage tank located on shore or on a second floating vessel, as indicated at 220.

Figure 3:
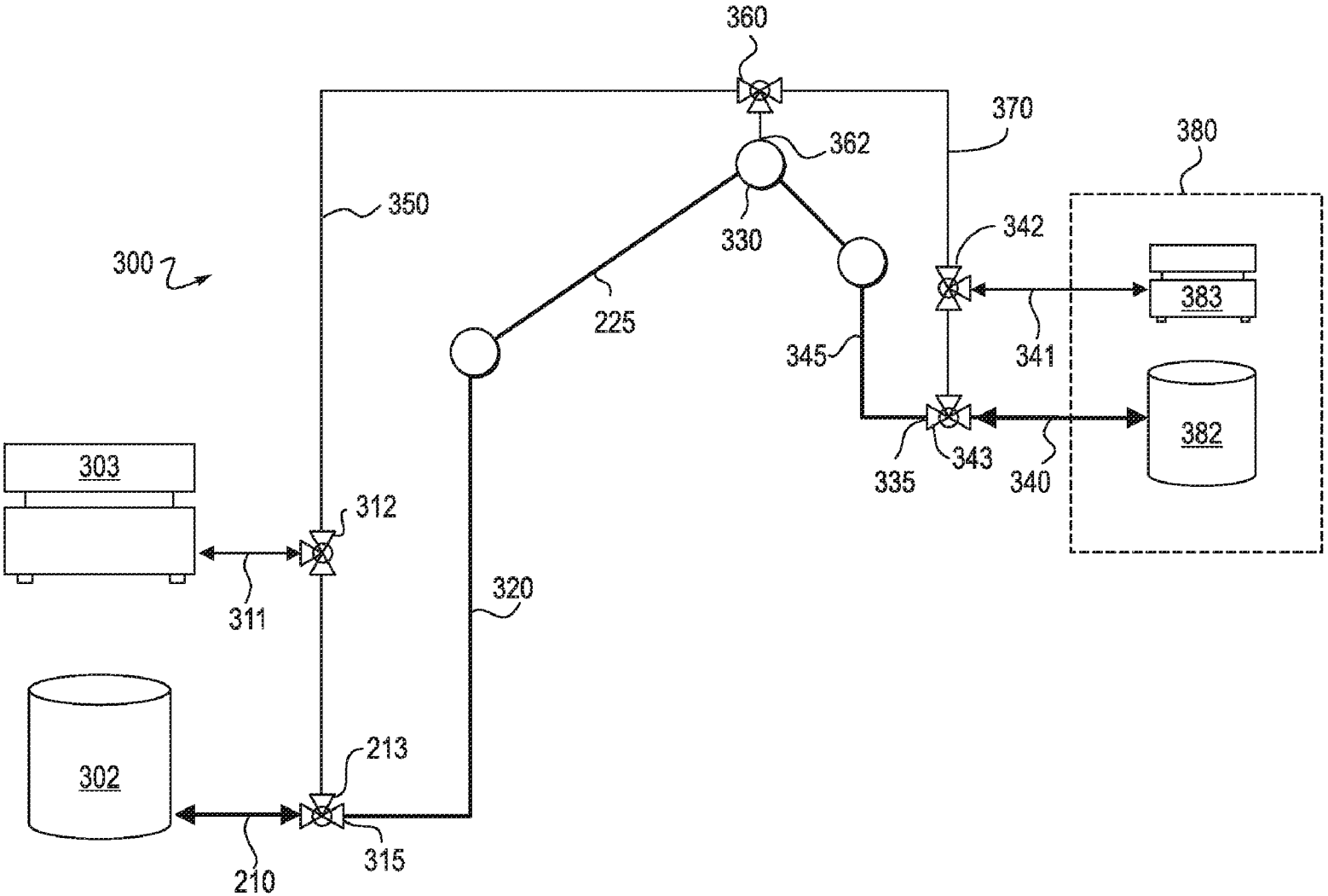
FIG. 3 is a schematic representation of an apparatus for use in a method of the present invention.

FIG. 3 illustrates an apparatus 300 that may be used in a method of the present invention. The apparatus includes an onshore cryogenic storage tank 302 and liquefaction unit 303, and cryogenic storage tank 382 and liquefaction unit 383 disposed onboard floating vessel 380. Flow line 340 is for delivering cryogenic fluid from tank 382 to the first end 335 of conduit 320. As illustrated, conduit 320 has first end 335, vertical section 345, joint 330, downstream section 325 and second end 315. Although the onboard manifold for vessel 380 is not illustrated, valves 342 and 343 control the flow of cryogenic fluids between liquefaction unit 383, storage tank 382, vertical section 345, and cool down line 370.

During a cool-down operation, a reduced flow of cryogenic fluid is pumped into the first end 335 and conduit section 345. A reduced flow of cryogenic fluid is also pumped through cool down line 370 and into conduit 320 at intermediate point 362. The cryogenic fluid entering the conduit at intermediate point 362 flows down through downstream section 325 toward second end 315 of conduit 320. The result is that vertical section 345 and downstream section 325 on either side of joint 330 are cooled simultaneously, thereby reducing the time required to cool the conduit as a whole.

Cool down line 350 is connected with storage tank 302 and liquefaction unit 303 on shore, and can serve as an alternative source of cryogenic fluid for use in cooling conduit 320. In some embodiments, a reduced flow of cryogenic fluid can be pumped into second end 315 and intermediate point 362 during a cool down operation. In other embodiments, a reduced flow of cryogenic fluid can be pumped into each of first end 335, second end 315 and intermediate point 362 during the cool down operation. Moreover, depending on the flows of cryogenic fluid to intermediate point 362, or to a second intermediate point (not shown), liquefaction unit 303 or 383 can be used to re-condense boil off gas that is vaporized during the cool down procedure.

Figure 4:
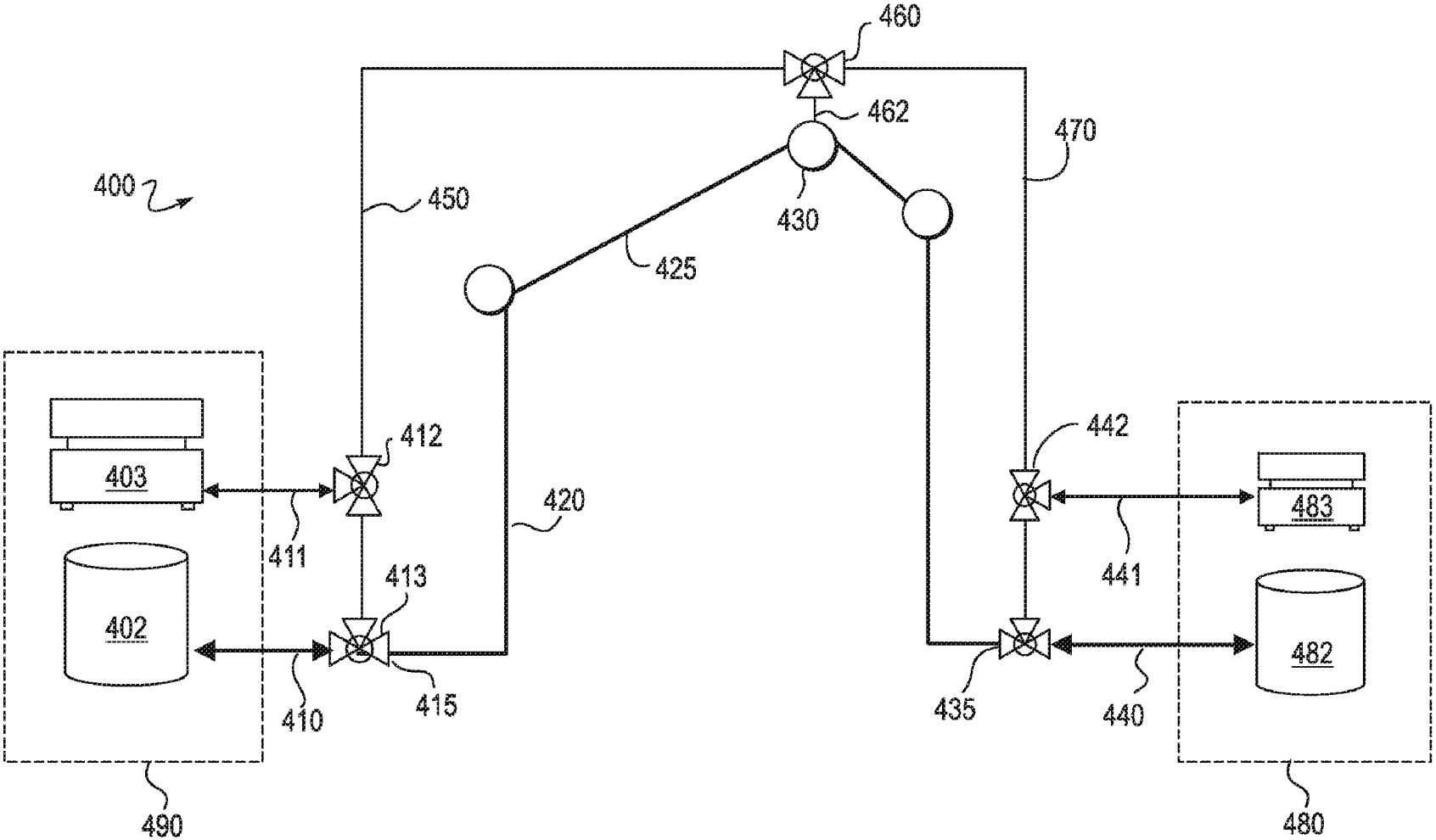
FIG. 4 is a schematic representation of an apparatus for use in a method of the present invention.

FIG. 4 illustrates an apparatus 400 that may be used in a method of the present invention. The apparatus includes cryogenic storage tank 402 and liquefaction unit 403 that are located on floating vessel 490 and cryogenic storage tank 482 and liquefaction unit 483 that disposed on floating vessel 480. Flow line 440 is for delivering cryogenic fluid from tank 482 to the first end 435 and vertical section 445 of conduit 420. As illustrated, conduit 420 has first end 435 and vertical section 445 of conduit 420. As section 425 and second end 415. Although the onboard manifold for vessel 480 is not illustrated, valves 442 and 443 control the flow of cryogenic fluids between liquefaction unit 483, storage tank 482, first end 434, and cool down line 470. Similarly, valves 412 and 413 control the flow of cryogenic fluids between liquefaction unit 403, storage tank 402, second end 415 and cool down line 450 of conduit 420.

During a cool-down operation, a reduced flow of cryogenic fluid is pumped into conduit section 445. A reduced flow of cryogenic fluid is also pumped through cool down line 470 and into conduit 420 at intermediate point 462. The cryogenic fluid entering the conduit at intermediate point 462 flows down through downstream section 425 toward the second end of the conduit. The result is that sections of conduit 420 on both sides of joint 430 are cooled simultaneously thereby reducing the time required to cool conduit as a whole.

Cool down line 450 is connected with storage tank 402 and liquefaction unit 403 on vessel 490, which can serve as an alternative source of cryogenic fluid for use in cooling conduit 420. In some embodiments, a reduced flow of cryogenic fluid can be pumped into second end 415 and intermediate point 462 during a cool down operation. In other embodiments, a reduced flow of cryogenic fluid can be pumped into each of first end 435, second end 415 and intermediate point 462 during the cool down operation. Moreover, depending on the flows of cryogenic fluid to intermediate point 462 or a second intermediate point (not shown), liquefaction units 403 or 483 can be used to re-condense boil off gas that is vaporized during the cool down operation.

Figure 5:
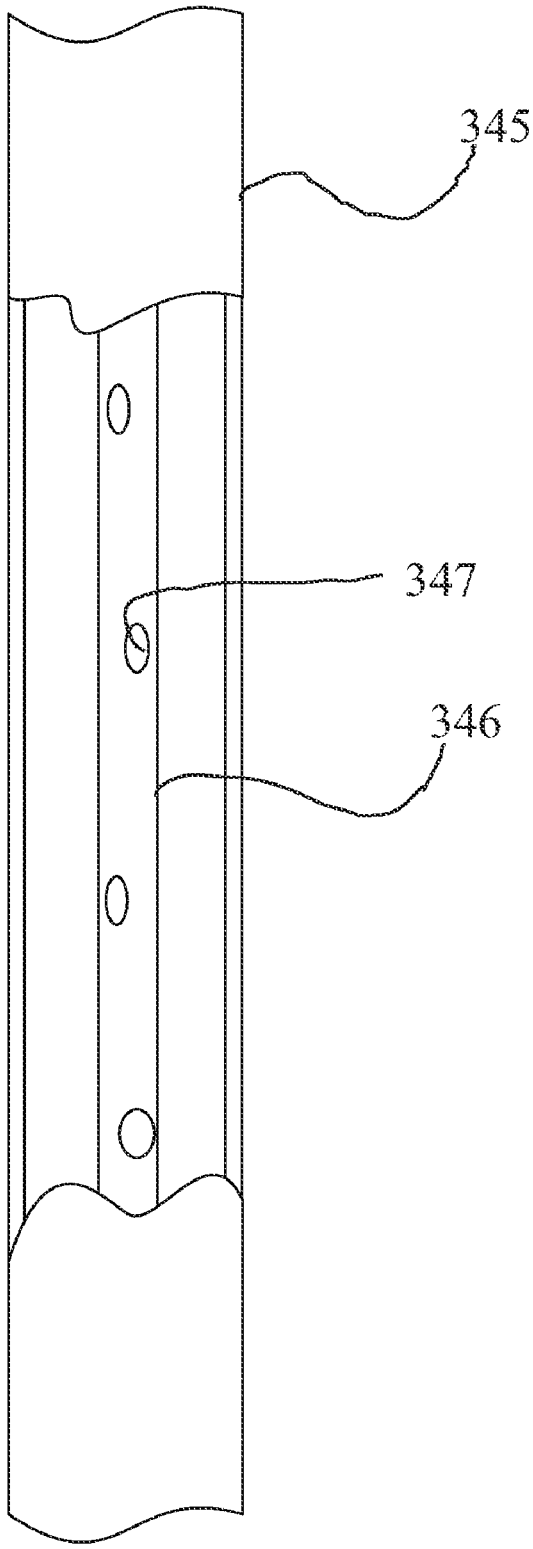
FIG. 5 is a schematic representation of a first cool down line disposed within a conduit and in fluid communication with the conduit through one or more openings in the first cool down line.

FIG. 5 shows that a first cool down line 346 is disposed within a conduit, such as 345 of FIG. 3, and is in fluid communication with conduit 345 through an opening 347 in the first cool down line.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A method for transferring a cryogenic fluid to or from a floating vessel, the method comprising the steps of:

pumping a reduced flow of a cryogenic fluid into a first end and/or a second end of a conduit which is substantially empty of cryogenic fluid prior to the cryogenic fluid being introduced into the conduit;

pumping a reduced flow of the cryogenic fluid into the conduit at a point intermediate the first end and the second end whereby multiple sections of the conduit are cooled simultaneously; and pumping an increased flow of the cryogenic fluid into the first end of the conduit to or from a floating vessel when the conduit has cooled to a temperature suitable for transferring the cryogenic fluid.

2. The method of claim 1, wherein the cryogenic fluid comprises one or more of methane, propane, ethane, butane, ammonia and mixtures of the same.

3. The method of claim 1, wherein the cryogenic fluid is at an elevated pressure.

4. The method of claim 3, wherein the elevated pressure is a pressure between about 15 psig and about 650 psig.

5. The method of claim 1, wherein the cryogenic fluid is at a temperature less than about −50° C.

6. The method of claim 5, wherein the cryogenic fluid is at a temperature less than about −100° C.

7. The method of claim 6, wherein the cryogenic fluid is at a temperature less than about −150° C.

8. The method of claim 1, wherein the reduced flow of cryogenic fluid is pumped into the conduit at an intermediate point between the first end and the second end by directing the reduced flow of cryogenic fluid through a first cool down line in fluid communication with the conduit at the intermediate point.

9. The method of claim 8, wherein the intermediate point is at an apex in the conduit.

10. The method of claim 8, wherein the first cool down line is disposed within the conduit and is in fluid communication with the conduit through one or more openings in the first cool down line.

11. The method of claim 1, wherein the reduced flow of cryogenic fluid pumped to the first end and/or second end of the conduit is derived from a storage tank or liquefaction unit located on-board a floating vessel and/or from a storage tank or liquefaction unit located on shore.

12. The method of claim 1, wherein the reduced flow of the cryogenic fluid pumped into the conduit at a point intermediate the first end and the second end is derived from a storage tank or liquefaction unit located on-board a floating vessel and/or from a storage tank or liquefaction unit located on shore.

13. The method of claim 1, wherein a portion of the reduced flow of cryogenic fluid pumped into the conduit forms a boil off gas, the method further comprising the step of removing the boil off gas from the conduit or a storage tank receiving the reduced flow of cryogenic fluid.

14. The method of claim 13, further comprising directing the removed boil off gas to a liquefaction unit on-board a floating vessel or on shore.

15. The method of claim 1, wherein the reduced flow of cryogenic fluid pumped into the first end and/or the second end of the conduit is pumped up through a vertical section of the conduit.

16. The method of claim 1, further comprising interrupting the reduced flow of cryogenic fluid into the conduit at the point intermediate when the conduit has cooled to a temperature appropriate for transferring the cryogenic fluid.

17. The method of claim 1, further comprising the step of purging the conduit with an inert fluid before pumping a reduced flow of cryogenic fluid into the conduit.

18. The method of claim 1, further comprising directing the increased flow of cryogenic fluid from the conduit to a storage tank located on shore or a second floating vessel.

19. A method for transferring a cryogenic fluid from a floating vessel, the method comprising the steps of:

pumping a reduced flow of a cryogenic fluid into a first end and/or a second end of a conduit;

pumping a reduced flow of the cryogenic fluid into the conduit at a point intermediate the first end and the second end;

pumping a reduced flow of the cryogenic fluid into the conduit at a second intermediate point between the first end and the second end; and pumping an increased flow of the cryogenic fluid into the first end of the conduit from a floating vessel when the conduit has cooled to a temperature suitable for transferring the cryogenic fluid.

20. The method of claim 19, wherein the reduced flow of cryogenic fluid is pumped into the conduit at the second intermediate point through a first cool down line.

21. The method of claim 19, wherein the reduced flow of cryogenic fluid is pumped into the conduit at the second intermediate point by directing the reduced flow of cryogenic fluid through a second cool down line in fluid communication with the conduit at the second intermediate point.

* * * * *

UNITED STATES PATENT AND TRADEMARK OFFICE

CERTIFICATE OF CORRECTION

PATENT NO. : 7,726,359 B2
APPLICATION NO. : 11/613722
DATED : June 1, 2010
INVENTOR(S) : Hartono et al.

It is certified that error appears in the above-identified patent and that said Letters Patent is hereby corrected as shown below:

In the Specification, Column 7, the paragraph starting on line 4 and ending on line 9, please make the following correction:

The sentence -- "The removed boil off gas can be directed to a liquefaction unit on-board a floating vessel or on shore where it will be re-condensed and directed to an on-board power generation unit or used in other on-board operations."

Should read --The removed boil off gas can be directed to a liquefaction unit on-board a floating vessel or on shore where it will be re-condensed and directed to cryogenic storage. In an alternative embodiment, the vapor boil off gas can be directed to an on-board power generation unit or used in other on-board operations.--

Signed and Sealed this

Twentieth Day of July, 2010

David J. Kappos

David J. Kappos
*Director of the United States Patent and Trademark Office*